US007380422B2

(12) United States Patent
Kim et al.

(10) Patent No.: US 7,380,422 B2
(45) Date of Patent: Jun. 3, 2008

(54) DRUM TYPE WASHING MACHINE

(75) Inventors: Jae Kyum Kim, Gimhae-si (KR); Ho Cheol Kwon, Changwon-si (KR); Kang Mo Choi, Masan-si (KR)

(73) Assignee: LG Electronics Inc., Seoul (KR)

( * ) Notice: Subject to any disclaimer, the term of this patent is extended or adjusted under 35 U.S.C. 154(b) by 623 days.

(21) Appl. No.: 10/720,391

(22) Filed: Nov. 25, 2003

(65) Prior Publication Data

US 2004/0107739 A1 Jun. 10, 2004

(30) Foreign Application Priority Data

Nov. 28, 2002 (KR) ..... 10-2002-0074956

(51) Int. Cl.
*D06F 29/00* (2006.01)

(52) U.S. Cl. ..... 68/17 A; 68/13 R; 68/17 R; 68/58; 68/142

(58) Field of Classification Search ..... 68/13 A, 68/17 R, 17 A, 13 R, 58, 142
See application file for complete search history.

(56) References Cited

U.S. PATENT DOCUMENTS

| | | | | |
|---|---|---|---|---|
| 5,211,689 | A * | 5/1993 | Kobayashi | 206/5 |
| 5,419,855 | A * | 5/1995 | Kikuta | 252/587 |
| 5,794,290 | A * | 8/1998 | Roberts | 8/159 |
| 7,036,177 | B2 * | 5/2006 | Aouad et al. | 8/159 |

* cited by examiner

*Primary Examiner*—Michael Barr
*Assistant Examiner*—Jason Heckert
(74) *Attorney, Agent, or Firm*—Ked & Associates, LLP

(57) ABSTRACT

Disclosed is a drum type washing machine, by which washing performance is increased as well as laundry damage and water pollution are reduced. The present invention includes a tub provided in a cabinet to hold water, a drum rotatably installed in the tub, at least one or more ceramics, and at least one or more ceramic receivers provided on an inside of the drum to hold the ceramic therein.

24 Claims, 5 Drawing Sheets

DRUM TYPE WASHING MACHINE

This application claims the benefit of Korean Application (s) No. 10-2002-00074956 filed on Nov. 28, 2002, which is/are hereby incorporated by reference.

BACKGROUND OF THE INVENTION

1. Field of the Invention

The present invention relates to a washing machine, and more particularly, to a drum type washing machine, which is environment-friendly and has an excellent washing performance.

2. Discussion of the Related Art

Generally, in a drum type washing machine, the laundry, detergent, and water are put in a horizontally installed drum and washing is performed using both dissolving power of the detergent and friction between the water and the laundry rotated by a driving force of a motor. Hence, the washed laundry is almost damage-free, avoids entanglement thereof, and undergoes the washing effects of beating and rubbing.

Lately, a drum type washing/drying machine enabling to dry the washed laundry is widely used.

FIG. 1 is a perspective view of a drum type washing machine according to a related art and FIG. 2 is a cross-sectional view of a drum type washing machine according to a related art.

Referring to FIG. 1 and FIG. 2, a drum type washing machine according to a related art consists of a tub 4, a drum 6, a driving unit 10, an inlet hose 12, a detergent box 14, an and outlet hose 16. The tub 4 is provided in a cabinet 2 enclosing an exterior of the washing machine, and the drum 6 is rotatably installed in the tub 4. A motor provided in the driving unit 10 is connected to the drum 6 through a rotational shaft 8 to rotate the drum 6.

Water is put in the tub 4 via the inlet hose 12, and a detergent is dissolved in the water supplied to the detergent box 14 connected to the inlet hose 12 so as to be supplied to the tub 4. Moreover, the outlet hose 16 is provided for discharging externally the water held in the tub 4.

A door 18 is provided to an opening 2*a* formed at a front side of the cabinet 2. In this case, the laundry is put in or pulled out of the drum 6 through the opening 2*a*. A control box 20, in which an electric unit for controlling an operation of the washing machine and displaying an operational status of the washing machine, is provided to an upper front side of the cabinet 2.

A multitude of perforated holes 6*a*, via which the detergent and water put in the drum 4 pass, are formed at the drum 6, whereby the laundry in the drum 6 is washed by the perforating power of the detergent and water.

Moreover, a plurality of lifts 22 protrude from an inner circumference of the drum 6. The lifts 22 are rotated together with the drum 6 to generate a current of the water. Moreover, the laundry is lifted up by the lifters 22 in a rotational direction of the drum 6 and falls down, whereby the washing of the laundry is performed by the friction with the water.

An operation of the drum type washing machine according to the related art is explained as follows.

First of all, the laundry is put in the drum 6 the door 18 is closed to cut off the opening 2*a*, and a washing mode is selected, in turn. Water and detergent are then supplied to the tub 4 via the inlet hose 12 and the detergent box 14. In this case, once the water is supplied to the tub 4 up to a predetermined level, the water supply stops. The driving force from the driving unit 10 is transferred to the drum 6 to rotate for performing a washing step.

After completion of the washing step, rinsing and dewatering steps are sequentially executed through the similar procedures to complete the entire washing course.

Meanwhile, in case of the drum type washing/drying machine, a drying step is further executed to dry the dewatered laundry, whereby the entire washing/drying course is completed.

However, in the related art drum type washing machine, the laundry undergoes the excessive friction with the water to enhance the washing performance, whereby damage is caused to the laundry. Moreover, if an input amount of the detergent is increased to enhance the washing power, water pollution becomes a serious problem.

SUMMARY OF THE INVENTION

Accordingly, the present invention is directed to a drum type washing machine that substantially obviates one or more of the problems due to limitations and disadvantages of the related art.

An object of the present invention, which has been devised to solve the foregoing problem, lies in providing a drum type washing machine, by which washing performance is increased as well as laundry damage and water pollution are reduced.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drum type washing machine including a tub provided in a cabinet to hold water, a drum rotatably installed in the tub, at least one or more ceramics, and at least one or more ceramic receivers provided on an inside of the drum to hold the ceramic therein.

In this case, the ceramic receivers protrude along a circumferential direction of the drum in an axial direction of the drum to leave a predetermined distance from each other. The ceramic receiver is semi-circular, a curved portion of the ceramic receiver protrudes toward a rotational center of the drum, and a flat portion of the ceramic receiver adheres closely to the inside of the drum. Moreover, a housing of the ceramic receiver is formed long in the axial direction of the drum.

Meanwhile, the ceramic receiver includes a housing having one open side confronting the drum to enable to receive the ceramics and a multitude of holes at a circumference and a cover covering a topside of the housing.

In this case, the housing protrudes in an axial direction of the drum and is provided plurally along a circumferential direction of the drum to leave a predetermined interval from each other.

The housing is semi-circular, a curved portion of the housing protrudes toward a rotational center of the drum, and a flat portion of the housing is open to be covered by the cover and to adhere closely to the inside of the drum.

Moreover, a plurality of coupling holes are formed at the inside of the drum and a plurality of hooks protrude from a side of the housing to be fitted to the coupling holes, respectively. Preferably, the hooks are built in one body of the housing.

A guide groove is formed at a rim of the open side of the housing along an axial direction of the drum and the cover is inserted in the guide groove to be fixed thereto. In this case, the cover is built in one body of the drum. Moreover, a plurality of reinforcement ribs protrude from the cover toward the inside of the drum.

Meanwhile, the ceramic includes silicon oxide. Moreover, the ceramic may include aluminum oxide.

And, the ceramic is preferably a sintered body including silicon oxide and aluminum oxide.

The ceramics are provided as a plurality of ball type ceramics differing in size from each other. Moreover, an inside of the ceramic can be formed of an elastic material and an outside of the ceramic can be coated with a sintered body including silicon oxide and aluminum oxide.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

A drum type washing machine according to the present invention includes a tub, a drum, a ceramic alkalifying water, and a ceramic receiver receiving the ceramic.

Figure 1:
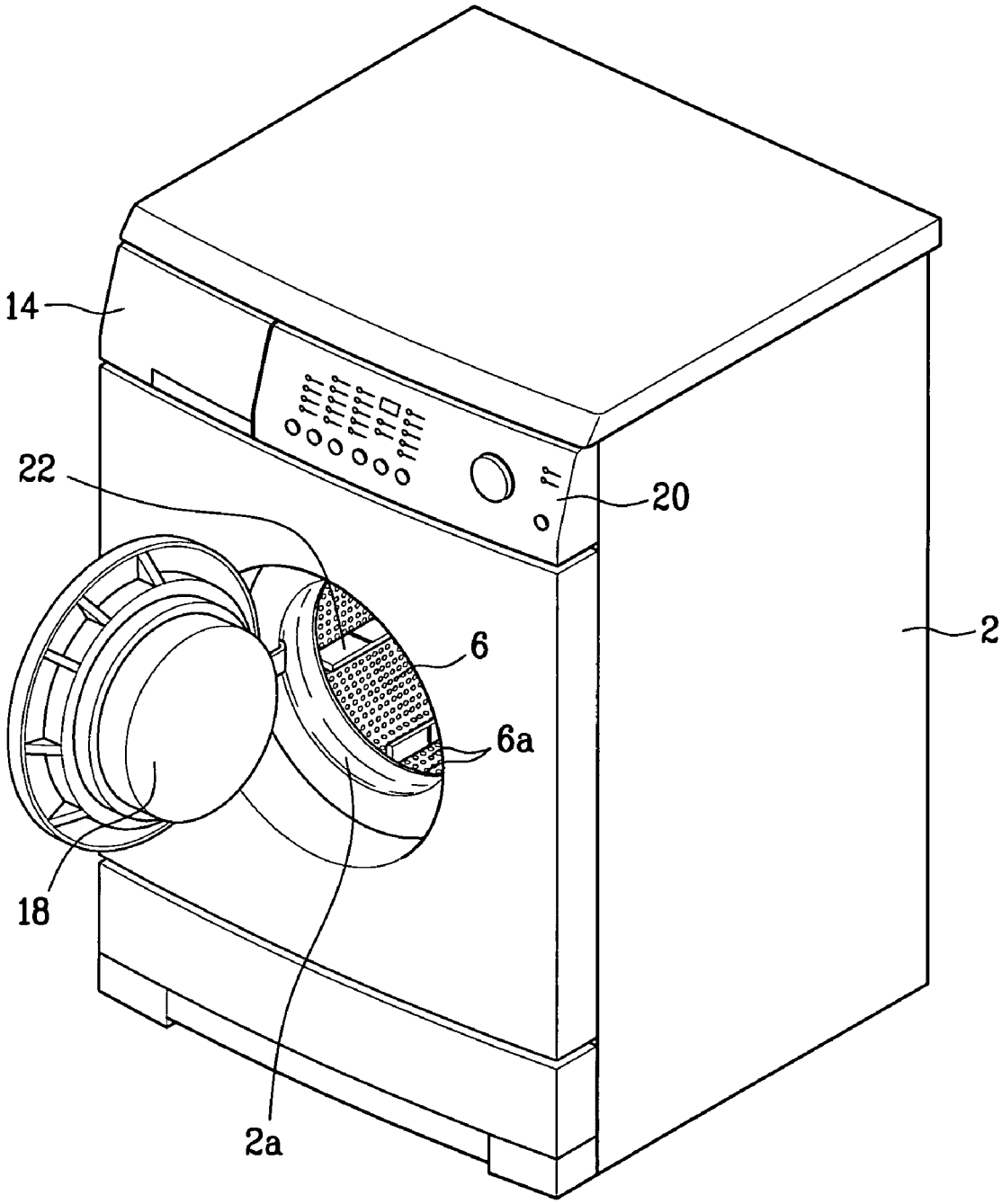
FIG. 1 Prior Art
FIG. 1 is a perspective view of a drum type washing machine according to a related art.
Figure 2:
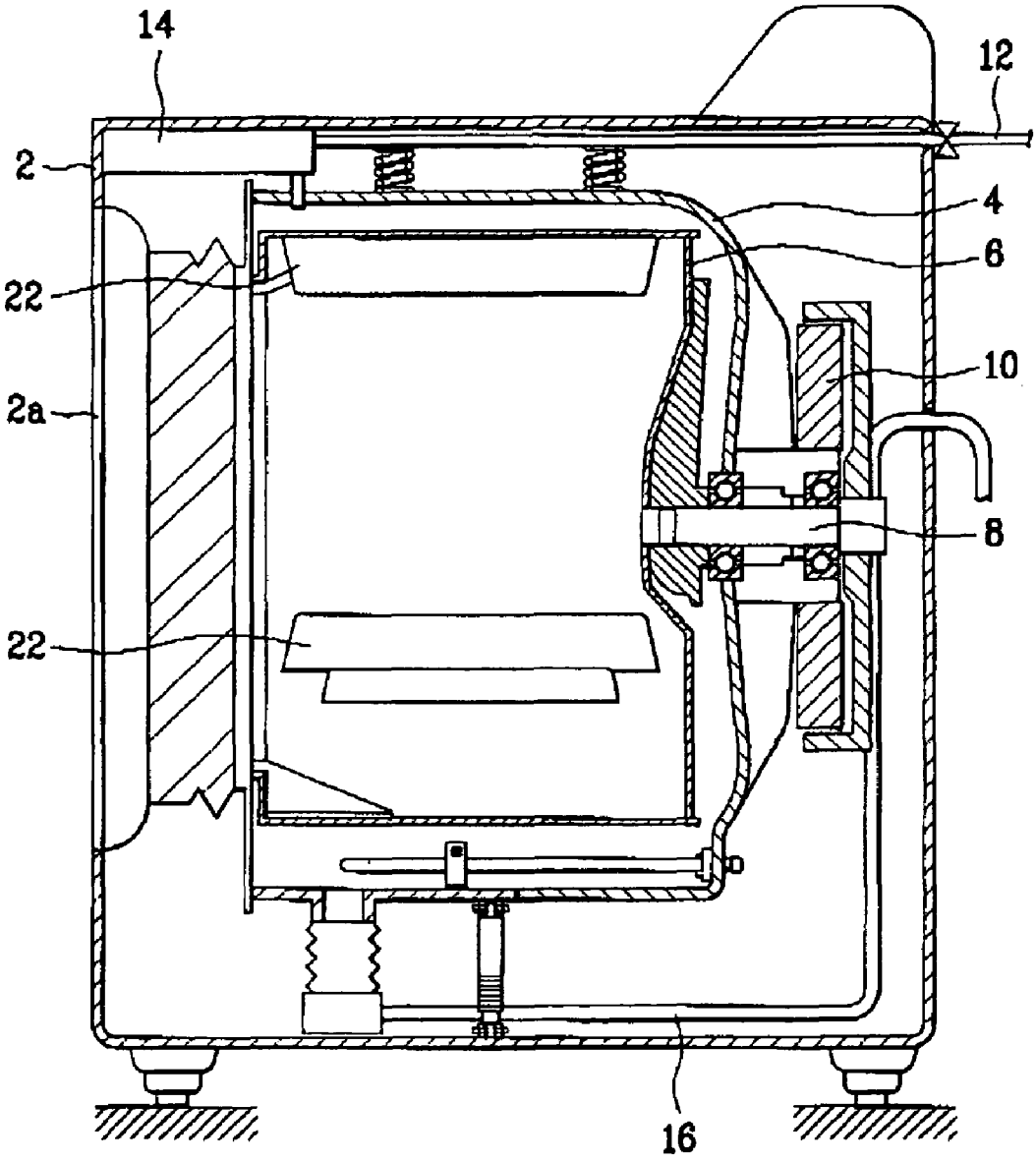
FIG. 2 Prior Art
FIG. 2 is a cross-sectional view of a drum type washing machine according to a related art.
Figure 3:
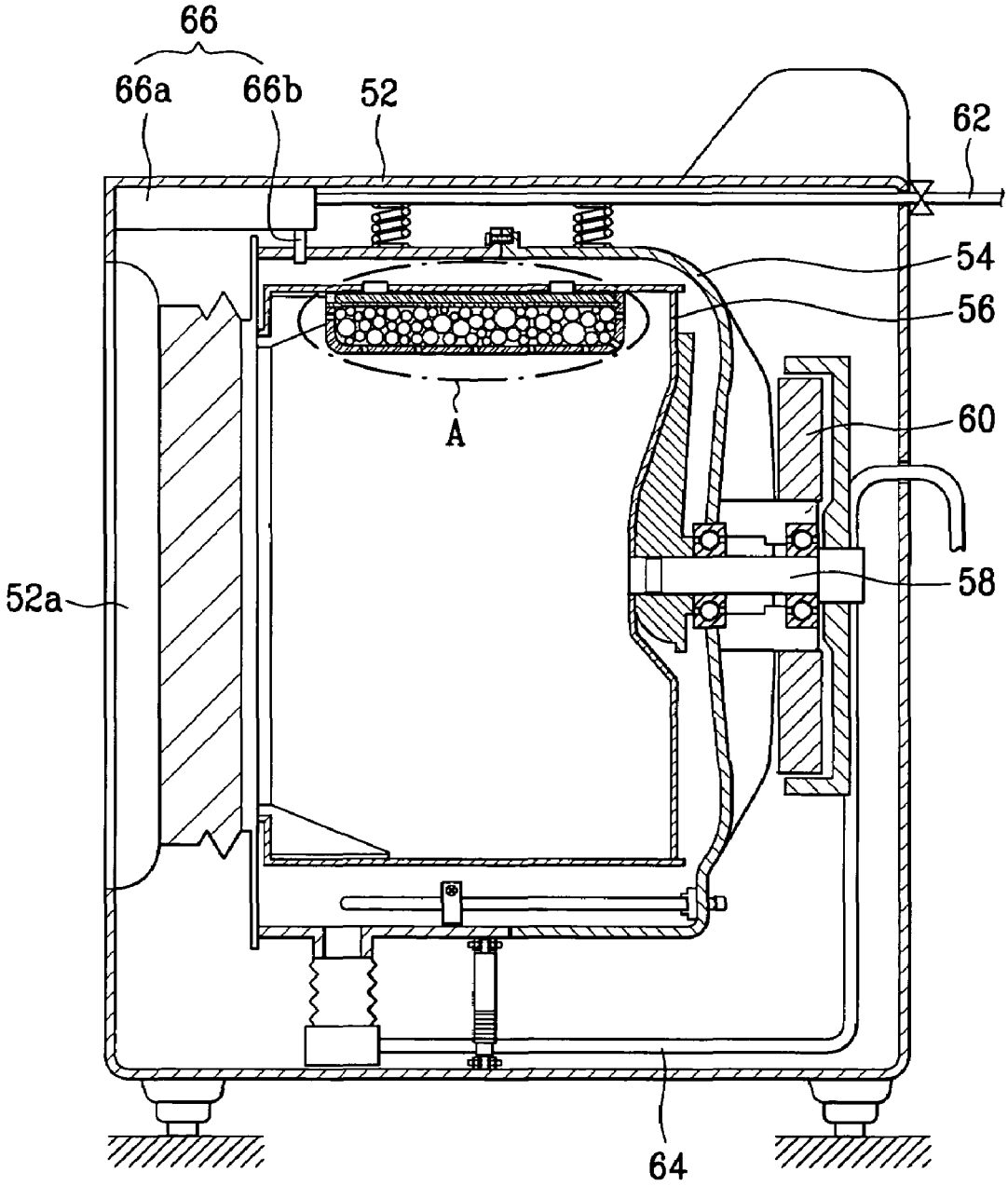
FIG. 3 is a cross-sectional view of a drum type washing machine according to the present invention.

FIG. 3 is a cross-sectional view of a drum type washing machine according to the present invention.

Referring to FIG. 3, an exterior of a drum type washing machine according to the present invention is covered with a cabinet 52, and an opening 52*a*, via which a laundry is put in or pulled out of a drum 56, is formed at a front side of the cabinet 52. A tub 54 is provided in the cabinet 52, and the drum 56 is rotatably installed in the tub 54. A driving motor 60 connected to the drum 56 through a rotational shaft 58 rotates the drum 56.

Water is put in the tub 54 via the inlet hose 62, and is discharged via an outlet hose 64.

A control box (not shown in the drawing), in which an electric unit for controlling an operation of the washing machine and displaying an operational status of the washing machine, is provided to an upper front side of the cabinet 52.

A door (not shown in the drawing) is provided to open/close the opening 52*a*.

A detergent supply assembly 66 includes a detergent box 66*a* and a supply pipe 66*b*. The detergent box 66*a* stores a detergent inside and is connected to one end of the inlet hose 12. Hence, the water and detergent mixed with each other at one end of the inlet hose 62 are supplied to the tub 54 via the supply pipe 66*b*. The detergent is partially dissolved in the proves of being put in the tub 54 and the drum 56, and the rest of the detergent is dissolved by a current generated from a rotation of the drum 56 to alkalize the water to facilitate to wash the laundry.

A multitude of perforated holes (not shown in the drawing), via which the detergent and water pass, are formed at the drum 56. And, a ceramic receiver is installed inside the drum to provide a ceramic alkalizing the water.

Figure 4:
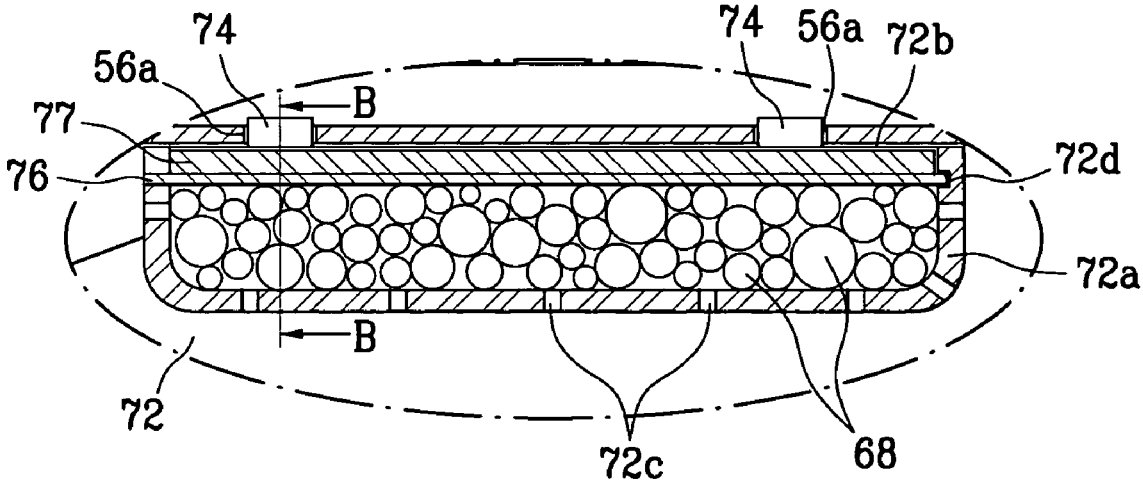
FIG. 4 is a magnified cross-sectional view of 'A' in FIG. 3.
Figure 5:
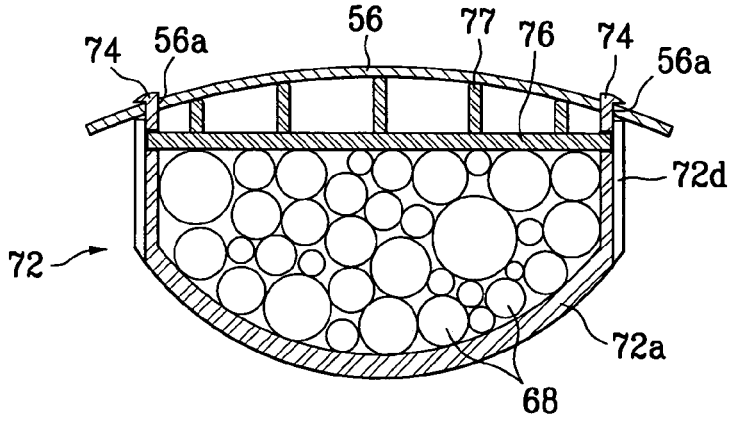
FIG. 5 is a cross-sectional view along a bisecting line 'B-B' in FIG. 4.
Figure 6:
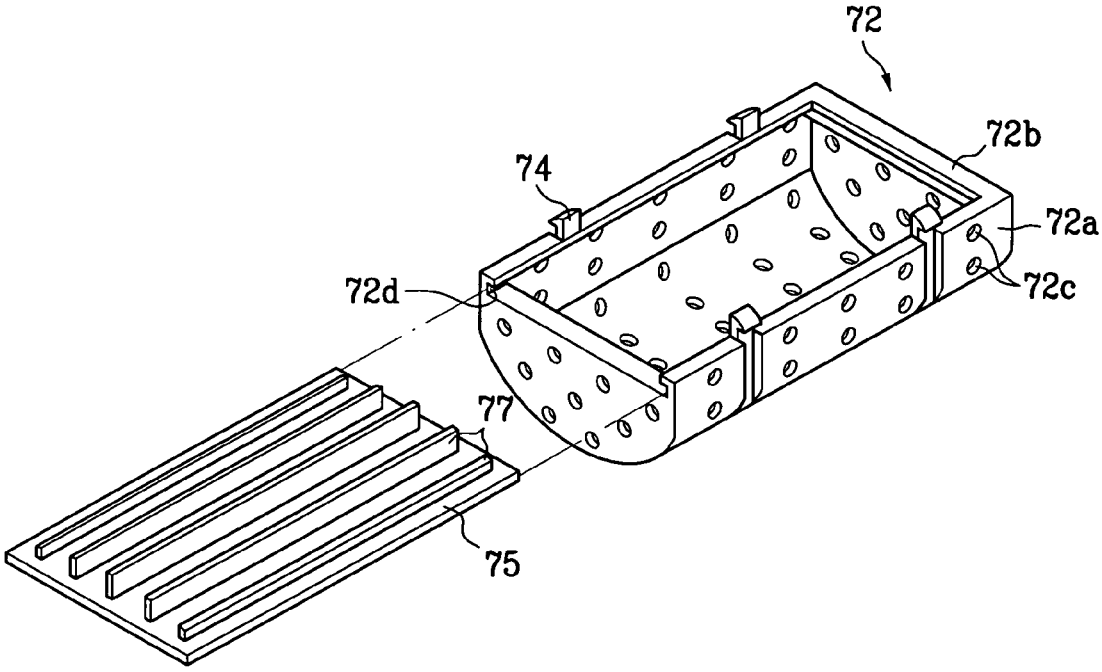
FIG. 6 is a perspective view of a ceramic receiver according to the present invention.

The ceramic receiver denoted by 'A" as shown in FIG. 3 and FIG. 4, is installed on an inside 56*a* of the drum 56. A ceramic 68, which alkalizes the water by reacting with the water to produce hydroxyl ions (OH—) is received in the ceramic receiver "A".

The ceramic 68 includes crystallized silicon oxide ($SiO_3$) and aluminum oxide ($Al_2O_3$). The ceramic 68 is brought contact with water to react. When water ($H_2O$) is supplied to the drum 56, silicon oxide ($SiO_3$) and aluminum oxide ($Al_2O_3$) are gradually dissolved in the water to produce hydroxyl ion ($OH^-$). Since surface tension of alkalized water is reduced, the alkalized water enables to penetrate the laundry with ease, whereby filth can be well separated from the laundry. Besides, such substances of the ceramic do not pollute the water.

The ceramic 68 is formed spherical to maximize its reactive area with the water and is plurally received in the ceramic receiver with various sizes.

For instance, an inside of the ceramic 68 is formed of such an elastic material as a rubber and the like and the ceramic substances are attached to a surface of the elastic material.

The ceramic receiver 'A' includes a housing 72*a* and hook 74.

In one embodiment of the present invention, a plurality of the ceramics 68 are received in the housing 72, and a multitude of perforated holes 72*c* are formed at the housing 72 to enable the ceramics to be contacted with the water. The housing 72 is inserted in a coupling hole formed on the inside 56*a* of the drum 56 to be coupled thereto by the hooks 74. In this case, the hooks 74 are preferably built in one body of the housing 72.

A front side of the receiver housing 72 is semi-circular so that a curved portion 72*a* protrudes toward a rotational center of the drum 56. A flat portion, which will be closely attached to the inside 56*a* of the drum 56, of the receiver housing 72 is formed open so that a plurality of the ceramics 68 are received through the opening 72*b*. And, a plurality of the hooks 74 are formed on a circumference of the opening 72*b*.

The housing 72 is formed long in an axial direction of the drum 56, and is installed to protrude toward the rotational center of the drum 56. Preferably, a plurality of the housings 72 are installed on the inside 56*a* of the drum 56 in a circumferential direction to leave a predetermined distance from each other. Hence, since the housing 72 is rotated together with the drum 56 on washing, the laundry is caught on the housing 72 to be lifted in the rotational direction of the drum 56 and then falls down by gravity. Namely, a plurality of the housings 72 play a role in the related art lifts.

Meanwhile, a guide groove 72*d* is formed at a rim of the opening 72*b* of the housing 72, and a cover 76 slides in the guide groove 72*d* to be fitted thereto. The cover 76 presses a plurality of the received ceramics 68 to the housing 72, thereby preventing the ceramics 68 from making noise due to collisions between the ceramics or between the ceramics and the drum 56. Moreover, the drum 56 and the housing 72 are prevented from being broken. And, the ceramics 68 are prevented from being separated from the housing 72.

In this case, the cover 76 has a plate shape, and a reinforcement rib 77 is provided to one side of the cover 76 confronting the inside of the drum 56. The reinforcement rib 77 extends to be contacted with the inside of the drum 56, thereby preventing the drum 56 from being distorted by the weight of the ceramics 68 and the housings 72.

Moreover, a rotational inertia of the drum 56 increases due to the weight of a plurality of the ceramics 68 and the ceramic receiver 'A', thereby interrupting generation of vibrations.

In another embodiment of the present invention, the cover is built in one body of the drum 56 and other elements are equivalent to those of the foregoing embodiment of the present invention. For convenience of assembly, a user loads the ceramics in the housing 72 and then makes the ceramic-loaded housing 72 slide in the guide groove 72*d* along the cover built in one body of the drum 56.

An operation of the above-constructed present invention is explained as follows.

First of all, the laundry is loaded in the drum 56 through the opening 52*a*, the opening 52*a* is closed by door, and the washing is executed, in turn. In this case, the water passes the inlet hose 62 and the detergent box 66 to be put in the tub 54 together with the detergent. After the water is supplied to the tub 54 to a predetermined level, the water supply stops. The drum 56 is then rotated by the driving motor 60.

As the drum 56 rotates, the water flowing in the housing 72 via the holes 72*c* of the housing reacts with the ceramics 68 to alkalize the water.

Hence, the drum type washing machine according to the present invention utilizes the alkalized water, the current according to the rotation of the drum 56, and the housings 72 playing a role of lifts to remarkably enhance the washing power according to the mechanical friction.

After completion of the washing step, rinsing/dewatering/drying steps are sequentially executed.

Accordingly, the drum type washing machine according to the present invention has the following advantages or effects.

First of all, the ceramics received in the drum alkalize the water to play a role of the detergent but fails to pollute the water. Therefore, the present invention reduces the detergent consumption but improves the washing performance.

Secondly, the housings for receiving the ceramics are plurally installed on the inside of the drum, whereby lifts are unnecessary. Therefore, the present invention has a less risk of additional cost.

Thirdly, the ceramics and housings increase the rotational inertia, thereby interrupting the generation of vibrations of the drum.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drum type washing machine, comprising:

a tub provided in a cabinet and configured to receive washing fluid;

a drum rotatably installed in the tub, wherein the drum includes an opening that faces a front of the cabinet so as to receive laundry items therethrough;

at least one ceramic piece; and at least one corresponding ceramic receiver provided on an inner surface of the drum and extending along an axial direction of the drum, wherein each ceramic receiver is configured to receive the at least one ceramic piece therein, and wherein each ceramic receiver comprises:

a housing having a first, open side configured to receive the at least one ceramic piece therein, and a second, circumferential side including a plurality of openings formed therein, wherein a peripheral edge of the first, open side of the housing is configured to be coupled to the inner surface of the drum, and wherein the housing so coupled to the drum is configured to lift laundry items in the drum as the drum rotates; and a cover positioned between the first, open side of the housing and the inner surface of the drum, wherein the cover comprises a first side configured to extend across the first, open side of the housing, and a second side comprising a plurality of ribs that extend outward from the second side of the cover wherein distal ends of the plurality of ribs are configured to contact the inner surface of the drum so as to maintain a position of the cover relative to the first, open side of the housing.

2. The drum type washing machine as claimed in claim 1, wherein the at least one ceramic receiver extends along an inner circumference of the drum, in an axial direction of the drum.

3. The drum type washing machine as claimed in claim 2, wherein a cross section of the at least one ceramic receiver is substantially semi-circular, and wherein a curved portion of the at least one ceramic receiver extends toward a rotational center of the drum, and the peripheral edge of the first, open side of the housing comprises a flat portion that is affixed to the inner surface of the drum.

4. The drum type washing machine as claimed in claim 2, wherein the housing of the at least one ceramic receiver is formed long in the axial direction of the drum.

5. The drum type washing machine as claimed in claim 1, wherein the at least one ceramic receiver comprises a plurality of ceramic receivers each with a housing which extends in an axial direction of the drum, wherein the ceramic receivers are positioned along a circumferential direction of the drum at a predetermined interval from each other.

6. The drum type washing machine as claimed in claim 1, wherein the housing is substantially semi-circular, and wherein a curved portion of the housing extends toward a rotational center of the drum, and wherein the open side of the housing faces the inner surface of the drum and is configured to be covered by the cover such that the cover is disposed between the housing and the drum and closely positioned against the inside of the drum.

7. The drum type washing machine as claimed in claim 1, wherein a plurality of coupling holes are formed in the inner surface of the drum, and wherein the housing comprises a corresponding plurality of hooks protruding from a side of the housing so as to be fitted to respective coupling holes.

8. The drum type washing machine as claimed in claim 7, wherein the plurality of hooks are built as a single body with the housing.

9. The drum type washing machine as claimed in claim 1, wherein a guide groove is formed at a rim of the first, open side of the housing along an axial direction of the drum, and wherein the cover is configured to be inserted in the guide groove so as to couple the cover to the housing.

10. The drum type washing machine as claimed in claim 9, wherein the cover is built as a single body with the drum.

11. The drum type washing machine as claimed in claim 1, wherein a distal end of each of the plurality of reinforcement ribs contacts a corresponding portion of the inner surface of the drum.

12. The drum type washing machine as claimed in claim 1, wherein the at least one ceramic piece includes silicon oxide.

13. The drum type washing machine as claimed in claim 1, wherein the at least one ceramic piece includes aluminum oxide.

14. The drum type washing machine as claimed in claim 1, wherein the at least one ceramic piece is a sintered body including silicon oxide and aluminum oxide.

15. The drum type washing machine as claimed in claim 1, wherein the at least one ceramic piece comprises a plurality of ball type ceramic pieces in a plurality of sizes.

16. The drum type washing machine as claimed in claim 1, wherein an inside of the at least one ceramic piece comprises an elastic material, and an outside of the at least one ceramic piece is coated with a sintered body including silicon oxide and aluminum oxide.

17. A drum type washing machine, comprising:

a tub provided in a cabinet and configured to receive washing fluid therein;

a drum rotatably installed in the tub;

at least one ceramic piece, wherein an interior portion of the at least one ceramic piece is formed of an elastic material, and an exterior portion of the at least one ceramic piece is coated with a sintered body including silicon oxide and aluminum oxide; and at least one receiver provided on an interior surface of the drum and configured to receive at the at least one ceramic piece therein.

18. The drum type washing machine as claimed in claim 17, wherein a cross section of each receiver is substantially semi-circular, and wherein a curved portion of each receiver extends toward a rotational center of the drum, and a flat portion of each receiver is coupled to the interior surface of the drum.

19. The drum type washing machine as claimed in claim 17, wherein each receiver comprises:

a housing having an open side configured to receive the at least one ceramic therethrough, wherein the open side is configured to face a corresponding interior surface of the drum when the receiver is coupled thereto, and a circumferential surface comprising a plurality of openings formed therein; and a cover configured to cover the open side of the housing.

20. The drum type washing machine as claimed in claim 19, further comprising a plurality of coupling holes formed in the interior surface of the drum, and a corresponding plurality of hooks extending from the housing so as to engage with respective coupled holes and to couple the receiver to the drum.

21. The drum type washing machine as claimed in claim 19, further comprising a guide groove formed along a rim of the open side of the housing, wherein the cover is configured to be slidably inserted into the guide groove so as to couple the cover to the housing, wherein the cover is disposed between the housing and the interior surface of the drum when the receiver is installed in the drum.

22. The drum type washing machine as claimed in claim 17, wherein the at least one receiver comprises a plurality of receivers each extending along a longitudinal direction of the interior surface of the drum, and positioned circumferentially in the drum at predetermined intervals.

23. The drum type washing machine as claimed in claim 17, wherein the at least one ceramic piece comprises a plurality of substantially spherical ceramic pieces.

24. The drum type washing machine as claimed in claim 1, wherein a length of each rib of the plurality of ribs is based on a corresponding distance between the second side of the cover and the inner surface of the drum at a portion of the second side of the cover from which the rib extends.

* * * * *